US012553423B2

(12) United States Patent
Try

(10) Patent No.: US 12,553,423 B2
(45) Date of Patent: Feb. 17, 2026

(54) COMPRESSION DEVICE AND METHOD

(71) Applicant: L'Air Liquide, Societe Anonyme pour l'Etude et l'Exploitation des Procedes Georges Claude, Paris (FR)

(72) Inventor: Rasmey Try, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 47 days.

(21) Appl. No.: 18/612,499

(22) Filed: Mar. 21, 2024

(65) Prior Publication Data

US 2024/0318645 A1 Sep. 26, 2024

(30) Foreign Application Priority Data

Mar. 21, 2023 (FR) ..... FR 2302593

(51) Int. Cl.
*F04B 15/08* (2006.01)
*F04B 7/02* (2006.01)
*F04B 53/10* (2006.01)

(52) U.S. Cl.
CPC ..... *F04B 15/08* (2013.01); *F04B 7/02* (2013.01); *F04B 53/10* (2013.01)

(58) Field of Classification Search
CPC .. F04B 15/08; F04B 7/02; F04B 53/10; F04B 2015/0822; F04B 49/035; F04B 37/06;
(Continued)

(56) References Cited

U.S. PATENT DOCUMENTS 3,045,436 A * 7/1962 Gifford ..... F25B 9/14 62/149
4,639,197 A 1/1987 Tornare et al.
(Continued)

FOREIGN PATENT DOCUMENTS

EP 0 174 269 3/1986
EP 2 535 585 12/2012
(Continued)

OTHER PUBLICATIONS

French Search Report for FR 2 302 593, mailed Oct. 4, 2023.

*Primary Examiner* — Hoang M Nguyen
(74) *Attorney, Agent, or Firm* — Justin K. Murray

(57) ABSTRACT

The invention relates to a fluid compression device comprising a compression chamber accommodating a piston that is able to move between first and second ends of the compression chamber, the device comprising a regeneration circuit connecting the first and second ends of the compression chamber and having a regenerator, the supply pipe comprising a set of one or more valves, the device comprising at least one compressed-fluid discharge pipe comprising an upstream end connected to the compression chamber and a downstream end intended to be connected to a receiver of the compressed fluid, the device comprising a bypass pipe comprising an upstream end connected to the regeneration circuit and a downstream end connected to a recovery member, the bypass pipe being configured to draw a fluid fraction during a regeneration phase during which the piston is moved from the second end towards the first end of the compression chamber.

15 Claims, 1 Drawing Sheet

(58) Field of Classification Search
CPC ..... F04B 37/18; F04B 39/06; F04B 39/10; F04B 41/02; F04B 49/22; F17C 5/06; F17C 9/04; F17C 2221/012; F17C 2227/0157; Y02E 60/32
See application file for complete search history.

(56) References Cited

U.S. PATENT DOCUMENTS

| | | | | |
|---|---|---|---|---|
| 10,054,078 | B2 | 8/2018 | Joffroy et al. | |
| 2012/0317995 | A1 | 12/2012 | Brunnhofer et al. | |
| 2019/0063791 | A1* | 2/2019 | Durand | F25B 9/14 |
| 2021/0033085 | A1* | 2/2021 | Adler | F04B 9/133 |
| 2023/0067385 | A1 | 3/2023 | Pennec et al. | |
| 2024/0318784 | A1* | 9/2024 | Try | F17C 5/04 |

FOREIGN PATENT DOCUMENTS

| | | |
|---|---|---|
| FR | 2 904 401 | 2/2008 |
| FR | 3 007 077 | 12/2014 |
| FR | 3 107 103 | 8/2021 |

* cited by examiner

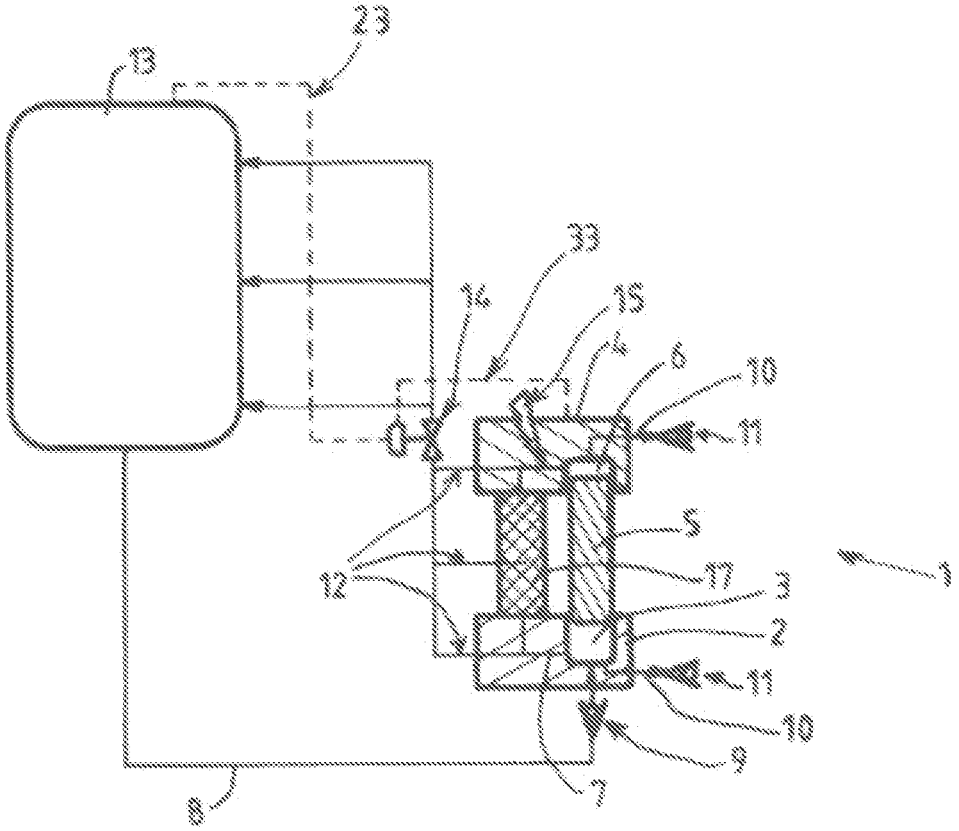
23
13
33
14
15
4
6
10
11
5
12
17
3
1
2
11
10
9
7
8

COMPRESSION DEVICE AND METHOD

CROSS REFERENCE TO RELATED APPLICATIONS

This application claims the benefit of priority under 35 U.S.C. § 119 (a) and (b) to French patent application No. FR2302593, filed Mar. 21, 2023, the entire contents of which are incorporated herein by reference.

FIELD OF THE INVENTION

The invention relates to a compression device and method.

BACKGROUND OF THE INVENTION

The documents FR2904401A1 and FR3007077A1 describe such a compression device, which is sometimes called a "thermal compressor".

Devices of this type may provide satisfactory efficiency. Solutions are sought to improve this efficiency and for example to optimize the energy required to manage the pressure in the supply storage of the device.

When in operation, such a device usually comprises the following steps.

Compression: the piston is in an end position in the second end of the compression chamber (relatively hot side of the device 1). The valve of the supply pipe has been opened, fluid (gas or liquid) has previously been introduced and fills the volume of the first end of the compression chamber (from the pressurized tank or via a pump). The piston is then actuated towards the first end of the compression chamber. This leads to a transfer of fluid from the first (cold) end towards the second (hot) end. In practice, the force needed is limited only by the transfer impedance of the gas through the regenerator.

When the gas heats up in the second, hot end, the pressure in the system begins to increase. The valve of the supply pipe is closed and the valve of the discharge pipe 10 remains closed as long as the pressure is below an opening threshold (for example the pressure of an outlet tank connected to the discharge pipe). The mass of excess fluid is then expelled via the valve of the discharge pipe at a preferably constant pressure. When the piston reaches the end position thereof at the bottom of the first end of the compression chamber, it preferably occupies all of this end volume of the compression chamber. During the transfer from the hot chamber towards the cold chamber, the cold of the fluid coming from the cold chamber stores the cold in the walls of the regenerator, to be restored to the fluid in the regeneration phase.

Regeneration: the piston is again moved towards the second end of the compression chamber (regeneration phase). This moves the fluid from the second (hot) end towards the first (cold) end of the compression chamber. During this process, the mass flow moves from the second (hot) end towards the first (cold) end. The fluid recovers the cold stored in the walls of the regenerator. As the fluid cools, the pressure in the compression device begins to drop. When the pressure in the first end of the compression chamber drops below a threshold, the valve of the discharge pipe closes and the valve of the supply pipe can open again to restart the process.

The latter step can generate a significant loss of efficiency of the thermal compressor. The fluid returning from the hot chamber effectively carries the inefficiencies of the regenerative exchanger (temperature pinch) and of compression (temperature differential caused by the compression in the previous cycle).

For example, in the case of compression of liquid hydrogen from 1 bar to 20 bar, the temperature increases naturally from 20.2 K to 21.1 K as a result of compression. This means that the cold side of the regenerator will be at least at a temperature of 21.1 K. This means that the fluid returning from the hot chamber will be at best equal to or greater than 21.1 K, plus the pinch of the regenerator. The quantity of heat injected into the cold chamber then corresponds to the return flow rate from the hot chamber multiplied by the enthalpy difference between 20.2 K and 21.1 K.

SUMMARY OF THE INVENTION

In certain embodiments, the invention relates more particularly to a fluid compression device having a compression chamber accommodating a mobile piston, the device comprising a first end accommodating a first end of the compression chamber, the device comprising a second end accommodating a second end of the compression chamber, the piston being able to move in translation between the first and second ends of the compression chamber, the device comprising a regeneration circuit connecting the first and second ends of the compression chamber and having a regenerator, the device comprising a supply pipe comprising an upstream end intended to be connected to a source of fluid to be compressed and a downstream end opening into the first end of the compression chamber, the supply pipe comprising a set of one or more valves, the device comprising at least one compressed-fluid discharge pipe comprising an upstream end connected to the compression chamber and a downstream end intended to be connected to a receiver of the compressed fluid.

The invention proposes an improvement of the efficiency of the thermal compressor and/or an energy optimization to reduce the energy consumed to pressurize the supply storage of the thermal compressor.

For this purpose, the device according to certain embodiments of the invention, while corresponding to the general definition given in the preamble above, is essentially characterized in that it comprises a bypass pipe comprising an upstream end connected to the regeneration circuit and a downstream end connected to a recovery member, the bypass pipe being configured to draw a fluid fraction during a regeneration phase during which the piston is moved from the second end towards the first end of the compression chamber.

Furthermore, embodiments of the invention may have one or more of the following features:

- the upstream end of the bypass pipe is connected to the regeneration circuit at the second end of the compression chamber and/or at the first end of the compression chamber and/or at the regenerator,
- the bypass pipe comprises a set of one or more valves, for example at least one pressure and/or flow rate regulation valve,
- the device comprises a liquefied-fluid tank, for example liquefied cryogenic fluid, constituting a fluid source connected to the upstream end of the supply pipe, and in that the recovery member comprises said tank,
- the bypass pipe comprises a pressure and/or flow rate regulation valve controlled as a function of the pressure inside the fluid tank and/or the pressure inside the compression chamber, for example at the second end of the compression chamber, the pressure and/or flow rate regulation valve is configured to provide controlled regulation as a function of the pressure differential between the pressure inside the fluid tank and the pressure inside the compression chamber, the set of one or more valves of the supply pipe comprises a non-return member such as a non-return valve, the second end of the device comprises a heating system, the first end of the device comprises a cooling or heating system, the regenerator comprises a heat exchanger tube, in particular a cylindrical tube, filled with a material configured to store and release the heat and to allow the fluid in the liquid and/or gaseous state to pass.

The invention can also relate to a method for compressing fluid by means of a device according to any one of the features above or below comprising the following successive steps: a) admission of a fluid in the liquid state at an initial pressure into the first end of the compression chamber via the supply pipe, b) compression by movement of the piston towards the first end of the compression chamber and transfer of the fluid from the first end of the compression chamber towards the second end of the compression chamber via the regeneration pipe, the second end of the device being kept at a temperature higher than the temperature of the first end, c) regeneration by movement of the piston towards the second end of the compression chamber and transfer of the fluid from the second end of the compression chamber towards the first end of the compression chamber, the method comprising, during the regeneration step c), a step of bypassing a fluid fraction outside the compression chamber from the second end of the compression chamber towards the first end of the compression chamber.

According to other possible features, the fluid in the liquid state is admitted into the first end of the compression chamber at an initial pressure from a liquefied-fluid tank, and in that the fluid fraction is sent towards this tank during the bypass step.

The invention may also relate to any alternative device or method comprising any combination of the features above or below within the scope of the claims.

Other features and advantages are set out in the description below, provided with reference to the FIGURES in which:

BRIEF DESCRIPTION OF THE DRAWINGS

Further features and advantages of the invention will become apparent from the description hereinafter of embodiments, which are given by way of illustration but without any limitation, the description being given in relation with the following attached FIGURES:

FIG. 1 shows a schematic and partial view in cross section illustrating an example of the structure and operation of an exemplary embodiment of a compression device according to the invention,

DETAILED DESCRIPTION OF THE INVENTION

Throughout the FIGURES, the same references relate to the same elements.

In this detailed description, the following embodiments are examples. Although the description refers to one or more embodiments, this does not mean that the features apply only to a single embodiment. Individual features of different embodiments can also be combined and/or interchanged in order to provide other embodiments.

The fluid compression device 1 illustrated in [FIG. 1] (or "thermal compressor") comprises a frame or casing accommodating a compression chamber in which a mobile piston 5 is housed. The device 1 comprises a first end 2 accommodating a first end 3 of the compression chamber (relatively cold end), the device 1 comprising a second end 4 accommodating a second end 6 of the compression chamber (relatively hot end). In this compressor, the two chambers or ends 3, 6 are usually practically at the same pressure, to within the pressure losses of the regenerative exchanger.

The piston 5 is able to move in translation between the first 3 and second 6 ends of the compression chamber (via any suitable drive system, which is not described for the sake of simplicity).

The device 1 comprises a regeneration pipe 7 connecting the first 3 and second 6 ends of the compression chamber and having a regenerator 17.

The device 1 also comprises a supply pipe 8 having an upstream end intended to be connected to a source 13 of fluid to be compressed and a downstream end opening into the first end 3 of the compression chamber. The source 13 is preferably a cryogenic fluid tank, for example liquefied hydrogen.

The tank 13 preferably contains a cryogenic fluid in a two-phase form and supplies the thermal compression device with liquid, preferably in a state close to saturation, and potentially subcooled. The diagram does not show pressure control members for the tank 13 (pressurization and/or depressurization system), which may be provided in a conventional manner.

The supply pipe 8 comprises a set of one or more valves, in particular a non-return valve 9. The device 1 comprises at least one compressed-fluid discharge pipe 10 comprising an upstream end connected to the compression chamber and a downstream end intended to be connected to a receiver of the compressed fluid. This discharge pipe 10 also comprises a set of one or more valves, for example a non-return valve 11.

For example, the upstream end of the compressed-fluid discharge pipe 10 is connected to the first and/or the second end of the compression chamber.

For example and as illustrated, the device 1 may comprise two discharge outlets (from the hot chamber and from the cold chamber). It is also possible to envisage a discharge at an intermediate temperature between these two ends.

For example, the upstream end of the compressed-fluid discharge pipe 10 is connected to the first end 3 of the compression chamber. This means that the compressed fluid is discharged from the relatively cold end 3 of the device 1. This enables relatively cold compressed fluid to be produced.

The regeneration pipe 7 is preferably separate from the discharge pipe 10. This means that this regeneration pipe 7 connects the two ends 3, 6 of the compression chamber by passing through the regenerator 17 and thus allows only direct transit between these ends during the movements of the piston 5.

The downstream end of the supply pipe 8 is preferably connected directly to the first end 3 of the compression chamber, i.e. without passing through a pre-compression chamber. This means that the fluid to be compressed is injected directly into the compression chamber 3.

Conventionally, the regenerator 17 can comprise a heat exchanger tube, in particular a cylindrical tube, filled with a material configured to store and release the heat and to allow the fluid in the liquid and/or gaseous state to pass. Of course, any other suitable heat exchanger structure can be envisaged.

Operation may be as follows: In a first compression step, the first (cold) end 3 is filled with cold fluid supplied by the tank 13. The second (hot) end 6 is at its minimal volume. The piston 3 is moved from the second end 6 towards the first end 3, forcing the fluid into the regenerator 17. The fluid is heated in the regenerator and optionally in an additional exchanger.

The fluid thus heated enables the ends 3, 6 of the compression chamber to be pressurized (iso-pressure). Once the delivery pressure has been reached, the outlet valve 11 opens. In a subsequent regeneration and injection phase, the piston 5 is moved from the first 3 towards the second 6 end, then forcing the fluid back into the regenerator 17. The fluid cools and enables the pressure inside the compressor to be reduced. Once this pressure is lower than the pressure of the tank 13, the supply valve 9 is opened. Thus, the incoming fluid (coming from the tank 13) and the fluid returning from the regenerator 17 mix together in the cold chamber (first end 3). The liquid level in the supply tank drops, which lowers the pressure inside the tank 13. An internal or external pressurization system can be used to maintain a pressure therein.

According to an advantageous feature, the device 1 further comprises a bypass pipe 12 comprising an upstream end connected to the regeneration circuit 7 and a downstream end connected to a recovery member 13 outside the compression chamber.

This bypass pipe 12 is configured to draw a fluid fraction during the regeneration phase during which the piston 5 is moved from the second 6 towards the first 3 end of the compression chamber to cool and lower the pressure of fluid that had been heated in the preceding phase.

This means that fluid is extracted from the thermal compressor during the regeneration phase. Extracting fluid in this phase means that less fluid is mixed with the supply liquid admitted into the first end 3 of the compression chamber.

Furthermore, since the return fluid flow rate from the second hot end 6 is reduced, the temperature pinch at the cold point of the regenerative exchanger 17 is improved.

This fluid bypass also reduces the quantity of heat returned to the first end 3 of the compression chamber as a result of compression inefficiency.

These two effects result in an increase of the liquid content at the end of the injection phase and therefore an increase in the efficiency of the device 1.

This helps to improve the operating efficiency of the device and can in particular be adapted to the fluid and the operating conditions.

This fluid fraction drawn by the bypass pipe 12 is preferably and optimally extracted at the second end 6 of the compression chamber (hot end). However, this bypass can withdraw the fluid at any point of the return between the second end 6 and the first end 3 (see the three withdrawal points shown by way of example).

The fluid withdrawn by the bypass pipe 12 is therefore relatively hot and at high pressure, close to the delivery pressure of the thermal compressor at the beginning of the regeneration phase. The pressure inside the compressor then drops as the fluid is extracted and a part of the fluid traverses the regenerator 17.

As illustrated, some or all of this fluid extracted from the thermal compressor may be returned to the tank 13, for example to pressurize the latter. This is because the pressure inside the tank tends to drop as a result of the flow rate of the thermal compressor. This both increases the efficiency of the thermal compressor and helps to limit the need to use a storage pressurization system. The reinjection point in the tank 13 may be positioned at any height of the tank 13, for example in the top in the expansion space.

The quantity of fluid withdrawn by the bypass pipe 12 towards the tank 13 to pressurize same may be an optimization and regulation variable of the device 1. For example, if the quantity of fluid bypassed is not enough to pressurize the tank 13, the pressure maintenance system for the tank 13 may be activated. Conversely, if the quantity of fluid bypassed is too high, it is possible to bypass only the quantity of fluid required for pressurization.

The bypass pipe 12 preferably comprises a pressure and/or flow rate regulation valve 14, which is for example controlled. For example, the valve 14 is controlled as a function of the pressure inside the fluid tank 13 and/or the pressure inside the compression chamber, and for example at the second end 6 of the compression chamber.

An active control system for the injection of this extracted fluid can be implemented to control the pressure differences between the thermal compressor (compression chamber) and the tank 13. During the injection phase, the pressure of the tank 13 is greater than the pressure inside the thermal compressor. During the compression and regeneration phases, the pressure of the compressor is greater than the pressure of the tank 13 up to a given point of the regeneration phase. The bypass valve 14 must therefore preferably be opened as a function of the pressure differential between the tank and the thermal compressor.

This enables inefficient energy from the thermal compressor to be used as efficient energy for the tank 13.

A buffer volume may be used on the bypass pipe 12 to smooth the quantity of gas returning into the tank 13.

The compression device 1 may be supplied with gas or liquid. Better compression performance is achieved in the latter case.

The invention is advantageously used to compress liquid hydrogen, but may also relate to a fluid that is chosen from the list comprising He, H2, Ne, CO, Ar, N2, O2, CH4, CO2, NO, Kr, Xe or any mixture of two or more of these chemical species.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

I claim:

1. A fluid compression device having a compression chamber accommodating a piston, the fluid compression device comprising:

a first end accommodating a first end of the compression chamber;

a second end accommodating a second end of the compression chamber, wherein the piston is configured to move in translation between the first and second ends of the compression chamber;

a regeneration circuit connecting the first and second ends of the compression chamber and having a regenerator;

a supply pipe comprising an upstream end intended to be connected to a source of fluid to be compressed and a downstream end opening into the first end of the compression chamber, the supply pipe comprising a set of one or more valves;

at least one compressed-fluid discharge pipe comprising an upstream end connected to the compression chamber and a downstream end intended to be connected to a receiver of the compressed fluid; and a bypass pipe comprising an upstream end connected to the regeneration circuit and a downstream end connected to a recovery member, the bypass pipe being configured to draw a fluid fraction during a regeneration phase during which the piston is moved from the second end towards the first end of the compression chamber.

2. The fluid compression device according to claim 1, wherein the upstream end of the bypass pipe is connected to the regeneration circuit at the second end of the compression chamber and/or at the first end of the compression chamber and/or at the regenerator.

3. The fluid compression device according to claim 1, wherein the bypass pipe comprises a set of one or more valves.

4. The fluid compression device according to claim 3, wherein the set of one or more valves of the bypass pipe is selected from the group consisting of pressure regulation valve, flow rate regulation valve, and combinations thereof.

5. The fluid compression device according to claim 4, the set of one or more valves are controlled as a function of the pressure inside the fluid tank and/or the pressure inside the compression chamber.

6. The fluid compression device according to claim 1, further comprising a liquefied-fluid tank constituting a fluid source connected to the upstream end of the supply pipe, and in that the recovery member comprises said tank.

7. The fluid compression device according to claim 6, wherein the bypass pipe comprises a pressure and/or flow rate regulation valve controlled as a function of the pressure inside the fluid tank and/or the pressure inside the compression chamber.

8. The fluid compression device according to claim 7, wherein the pressure and/or flow rate regulation valve are controlled as a function of the pressure at the second end of the compression chamber.

9. The fluid compression device according to claim 7, wherein the pressure and/or flow rate regulation valve is configured to provide controlled regulation as a function of the pressure differential between the pressure inside the fluid tank and the pressure inside the compression chamber.

10. The fluid compression device according to claim 1, wherein the set of one or more valves of the supply pipe comprises a non-return member, wherein the non-return member is a non-return valve.

11. The fluid compression device according to claim 1, wherein the second end of the device comprises a heating system.

12. The fluid compression device according to claim 1, wherein the first end of the device comprises a cooling or heating system.

13. The fluid compression device according to claim 1, wherein the regenerator comprises a heat exchanger tube, in particular a cylindrical tube, filled with a material configured to store and release the heat and to allow the fluid in the liquid and/or gaseous state to pass.

14. A method for compressing fluid by means of a device according to claim 1, the method comprising the following successive steps:

a) admitting a fluid in the liquid state at an initial pressure into the first end of the compression chamber via the supply pipe, b) compressing by movement of the piston towards the first end of the compression chamber and transfer of the fluid from the first end of the compression chamber towards the second end of the compression chamber via the regeneration pipe, the second end of the device being kept at a temperature higher than the temperature of the first end, c) regenerating by movement of the piston towards the second end of the compression chamber and transfer of the fluid from the second end of the compression chamber towards the first end of the compression chamber, wherein the method further includes, during the regeneration step c), a step of bypassing a fluid fraction outside the compression chamber from the second end of the compression chamber towards the first end of the compression chamber.

15. The method according to claim 14, wherein the fluid in the liquid state is admitted into the first end of the compression chamber at an initial pressure from a liquefied-fluid tank constituting the fluid source, and wherein the recovery member is said liquefied-fluid tank such that the fluid fraction is sent towards the liquefied-fluid tank during the bypass step.

* * * * *